US009079747B2

(12) United States Patent
Huang et al.

(10) Patent No.: US 9,079,747 B2
(45) Date of Patent: Jul. 14, 2015

(54) CONTAINER FOR ACCOMMODATING CABLE

(71) Applicants: Fu Tai Hua Industry (Shenzhen) Co., Ltd., Shenzhen (CN); HON HAI PRECISION INDUSTRY CO., LTD., A (TW)

(72) Inventors: Qun Huang, Shenzhen (CN); Zhou Chen, Shenzhen (CN)

(73) Assignees: Fu Tai Industry (Shenzhen) Co., Ltd., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 111 days.

(21) Appl. No.: 13/710,487

(22) Filed: Dec. 11, 2012

(65) Prior Publication Data

US 2013/0153701 A1 Jun. 20, 2013

(51) Int. Cl.
*B65H 75/48* (2006.01)
*B65H 75/44* (2006.01)

(52) U.S. Cl.
CPC ..... *B65H 75/4434* (2013.01); *B65H 75/4431* (2013.01); *B65H 2701/3919* (2013.01)

(58) Field of Classification Search
CPC . B65H 75/48; B65H 75/4431; B65H 75/4434
USPC ..... 242/378, 378.1–378.4
See application file for complete search history.

(56) References Cited

U.S. PATENT DOCUMENTS

| | | | | |
|---|---|---|---|---|
| 5,178,619 | A * | 1/1993 | Galazaka | 606/41 |
| 6,866,218 | B2 * | 3/2005 | Liao | 242/378.1 |
| 6,997,410 | B1 * | 2/2006 | Huang | 242/378.3 |
| 7,147,177 | B2 * | 12/2006 | Yen | 242/385.4 |
| 7,455,255 | B1 * | 11/2008 | Chao | 242/378.1 |
| 7,494,083 | B1 * | 2/2009 | Yen | 242/378.1 |

* cited by examiner

*Primary Examiner* — Sang Kim
(74) *Attorney, Agent, or Firm* — Novak Druce Connolly Bove + Quigg LLP

(57) ABSTRACT

A container for accommodating an electronic device cable includes a main base, a top cover, a winder rotatably connected to the main base, and a locking mechanism received in the winder. The top cover is placed on the main base, and defines an accommodating space in cooperation with the main base. The winder is received in the accommodating space, and includes a spring for providing a rotary force to the winder when the spring is twisted. The locking mechanism is received in the winder and configured for detachably fastening the winder to the top cover. When the cable is pulled away from the winder, the locking mechanism of the winder detaches from the top cover to allow unwinding of the cable to a desired length. Then when the transmission arm is pushed, the locking mechanism is driven away from the top cover whereupon the winder automatically rewinds the cable.

8 Claims, 7 Drawing Sheets

CONTAINER FOR ACCOMMODATING CABLE

BACKGROUND

1. Technical Field

The present disclosure relates to containers for electrical cables, and more particularly, to a container for accommodating a cable of an electronic device.

2. Description of Related Art

Many electronic devices such as cellular phones and the headphones of a music player use a long cable for transmitting electrical signals. However, the long cable is easy tangled when the electronic device is put away, which is inconvenient and bothersome for use the next time.

Therefore, it is desirable to provide a means which can overcome the above-mentioned problems.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

Embodiments of the present disclosure will now be described in detail below, with reference to the accompanying drawings.

Figure 1:
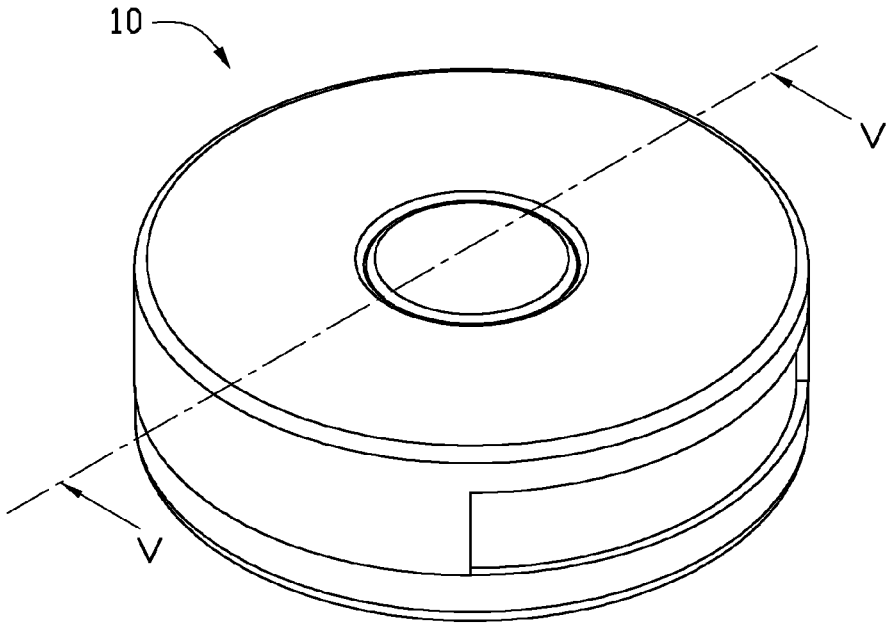
FIG. 1 is an isometric view of a container for accommodating a cable of an electronic device, according to an exemplary embodiment.
Figure 2:
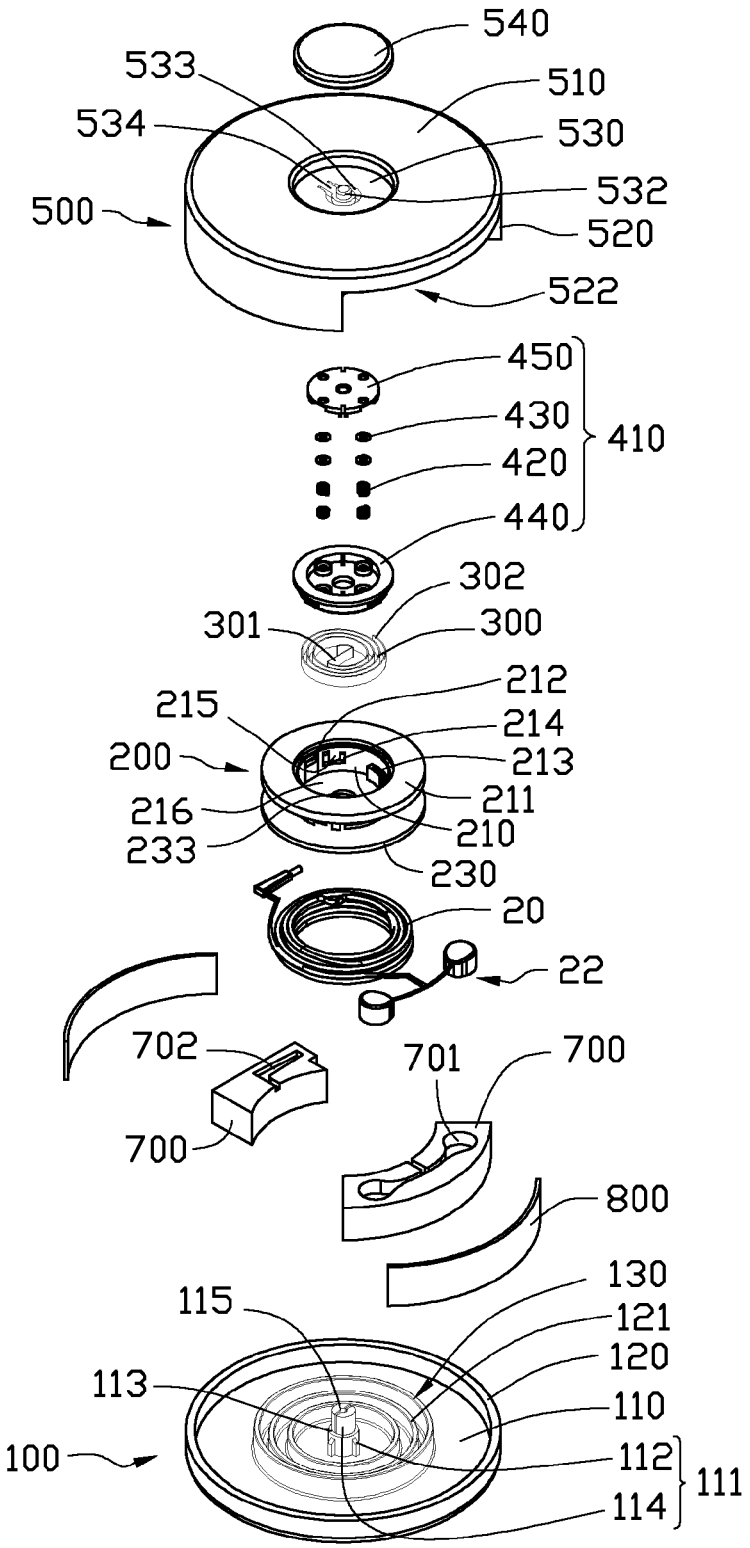
FIG. 2 is an exploded, isometric view of the container of FIG. 1, viewed from a first direction, the container including a locking mechanism.
Figure 3:
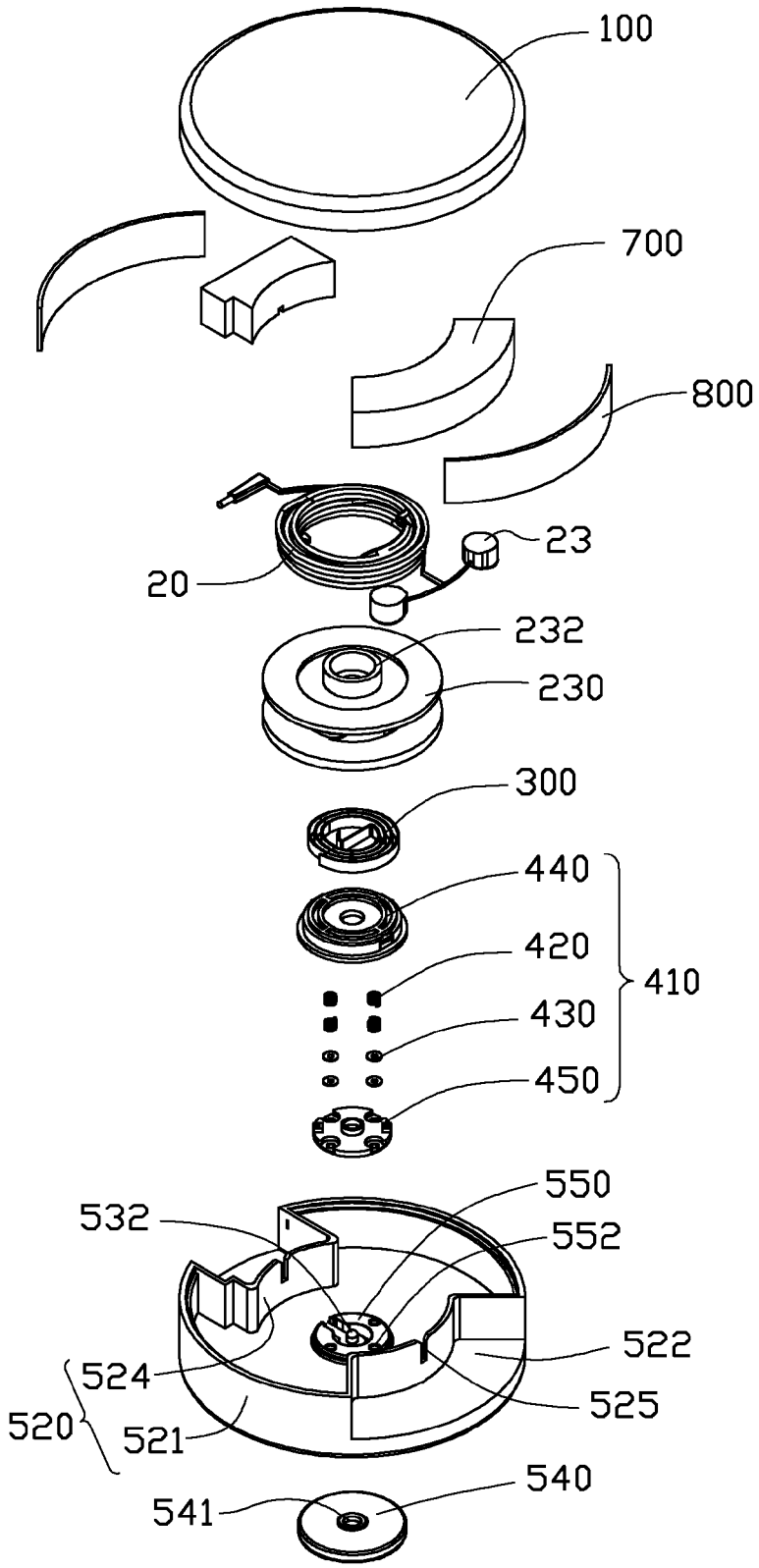
FIG. 3 is an exploded, isometric view of the container of FIG. 1, viewed from a second direction.

FIGS. 1-3 illustrate a container 10 in accordance with an exemplary embodiment. The container 10 is configured for accommodating a cable 20 of an electronic device 22. The electronic device 22 may be, for example, a pair of earphones of a music player or of a cellular phone. The container 10 may include a main base 100, a top cover 500, a button 540, a winder 200, a first spring 300, a locking mechanism 410, a pair of receiving blocks 700, and a pair of shielding boards 800. The top cover 500 is connected to the main base 100 and defines an accommodating space 150 (see FIG. 5) in cooperation with the main base 100. The cable 20 is wrapped on the winder 200. The winder 200, the first spring 300, and the locking mechanism 410 are accommodated in the accommodating space 150. The first spring 300 is received in the winder 200 for providing a rotary force to the winder 200. In this embodiment, the first spring 300 is a spiral spring, and includes an inner end 301 and an outer end 302. The winder 200 is detachably fastened to the top cover 500 via the locking mechanism 410. The button 540 is assembled to the top cover 500. The winder 200 is released from the top cover 500 to rotate when the cable 20 is pulled out from the winder 200, or when the button 540 pushes the locking mechanism 410 away from the top cover 500.

The main base 100 includes a bottom board 110, an outer sidewall 120, a positioning sidewall 130, a number of support sidewalls 121, and a holding post 111. The outer sidewall 120 extends up from a periphery of the bottom board 110. The positioning sidewall 130, the support sidewalls 121, and the holding post 111 each extend up from a top surface of the bottom board 110 in a direction parallel to the outer sidewall 120. The positioning sidewall 130 encircles the support sidewalls 121. In the illustrated embodiment, there are two support sidewalls 121. The radius of the support sidewall 121 close to the holding post 111 is less than the radius of the support sidewall 121 far from the holding post 111. The holding post 111 is encircled by the inner support sidewall 121. The height of the positioning sidewall 130 is greater than the height of the support sidewalls 121. In this embodiment, the bottom board 110 is circular. The holding post 111 is located on the center of the bottom board 110. The support sidewalls 121, the positioning sidewall 130, and the outer sidewall 120 are concentric rings arranged in that order from the center of the bottom board 110 to the periphery of the bottom board 110.

The holding post 111 includes an upper part 114 and a lower part 112. The radius of the upper part 114 is less than the radius of the lower part 112. Thus, a step 113 (also see FIG. 5) is formed at an intersection between the upper part 114 and the lower part 112. The holding post 111 defines a fastening slit 115 in a top of the upper part 114, the fastening slit 115 located along a diameter of the upper part 114. The fastening slit 115 has a predetermined depth from the top of the upper part 114 down toward the lower part 112. In the illustrated embodiment, the fastening slit 115 extends all the way down to a top extremity of the lower part 112. That is, a bottom of the fastening slit 115 is substantially coplanar with the step 113.

The winder 200 includes an upper board 211, a lower board 230, and a connecting sidewall 210. The winder 200 defines a bottom through hole 233 in the lower board 230. The connecting sidewall 210 extends from a top surface of the lower board 230, and can be considered to encircle the bottom through hole 233. The lower board 230 forms a bottom sidewall 232 on a bottom surface thereof. The bottom sidewall 232 is annular (or cylindrical), and can be considered to encircle the bottom through hole 233. The radius of the bottom through hole 233 is greater than the radius of the upper part 114, and is less than the radius of the lower part 112. An inner radius of the bottom sidewall 232 is slightly larger than the radius of the lower part 112.

The upper board 211 extends radially outward from a top periphery of the connecting sidewall 210. The upper board 211 is parallel to the lower board 230. An outer radius of the upper board 211 is the same as an outer radius of the lower board 230.

The winder 200 defines a number of U shaped positioning through holes 214 in the connecting sidewall 210. The positioning through holes 214 are distributed along a peripheral direction of the connecting sidewall 210, and are spaced at predetermined intervals. Each of the positioning through holes 214 defines a positioning protrusion 215 for fixing the cable 20. The winder 200 defines a number of positioning grooves 212 in an inner surface of the connecting sidewall 210. The positioning grooves 212 are close to the upper board 211, and are distributed along the peripheral direction of the connecting sidewall 210 at predetermined intervals. At least one positioning block 213 commonly extends from both the inner surface of the connecting sidewall 210 and the lower board 230. The connecting sidewall 210 and the lower board 230 cooperatively define a first receiving space 216 for receiving the first spring 300.

Figure 4:
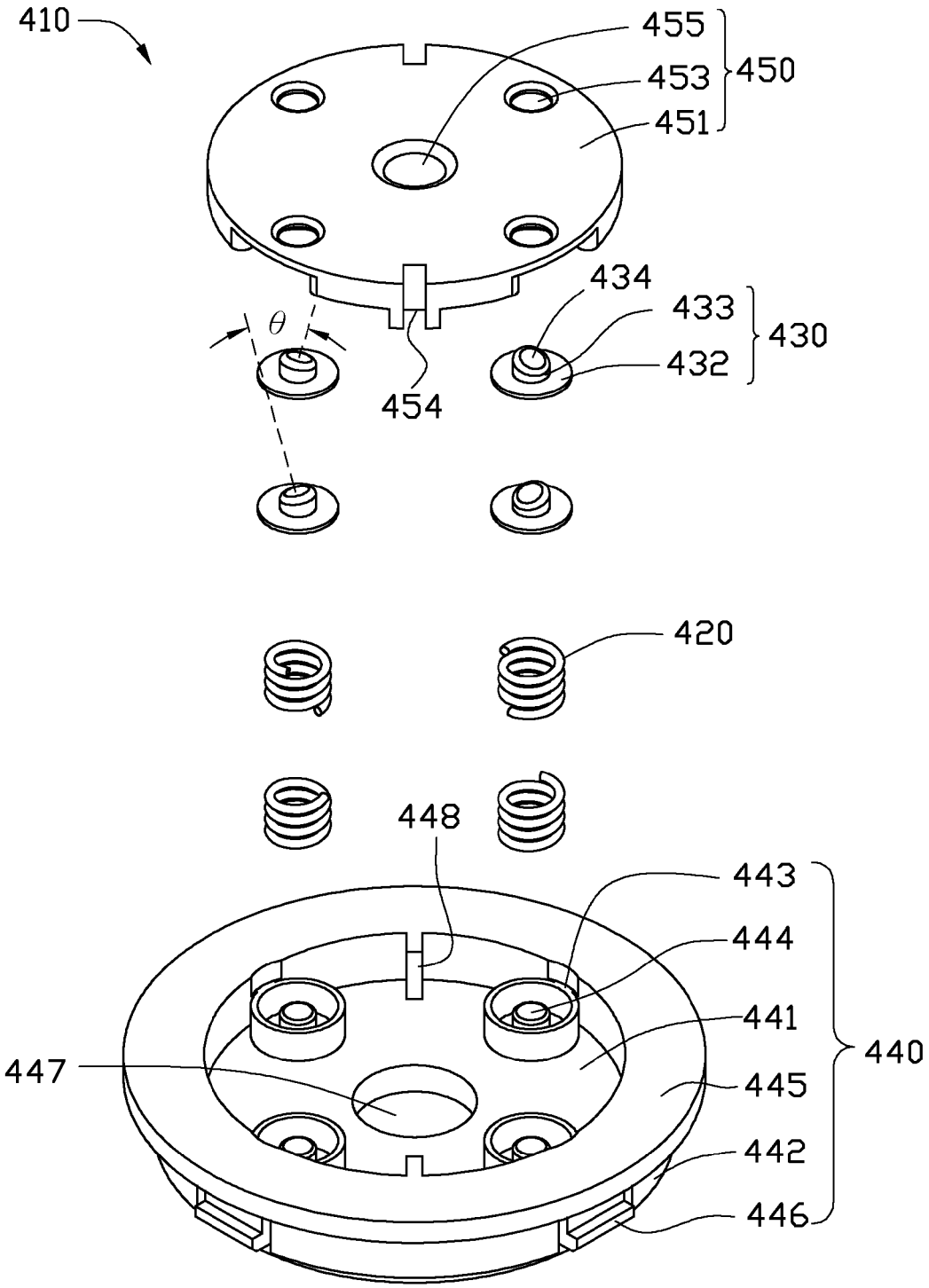
FIG. 4 is an enlarged view of the locking mechanism of FIG. 2.

FIG. 4 illustrates the detailed structure of the locking mechanism 410. The locking mechanism 410 includes a connecting base 440, a number of second springs 420, a number of locking blocks 430, and a pressing cover 450. The connecting base 440 includes a base board 441, a holding sidewall 442, a holding flange 445, a number of receiving sidewalls 443, and a number of fixing protrusions 444. The holding sidewall 442 extends from a periphery of the base board 441. The holding flange 445 extends radially outward from a top periphery of the holding sidewall 442. The receiving sidewalls 443 extend up from the base board 441 and are encircled by the holding sidewall 442. In the illustrated embodiment, there are four receiving sidewalls 443 arranged at the corners of an imaginary square. The fixing protrusions 444 extend up from the base board 441. In the illustrated embodiment, there are four fixing protrusions 444. Each receiving sidewall 443 encircles one corresponding fixing protrusion 444. The connecting base 440 defines a connecting through hole 447 in a center of the base board 441.

The holding sidewall 442 includes at least a pair of guiding projections 448 and a number of connecting projections 446. The guiding projections 448 radially extend from two opposite sides of an inner surface of the holding sidewall 442, respectively. The connecting projections 446 radially extend from an outer surface of the holding sidewall 442. The connecting projections 446 correspond to the positioning protrusions 215, and are distributed at predetermined intervals along a periphery of the holding sidewall 442.

Figure 5:
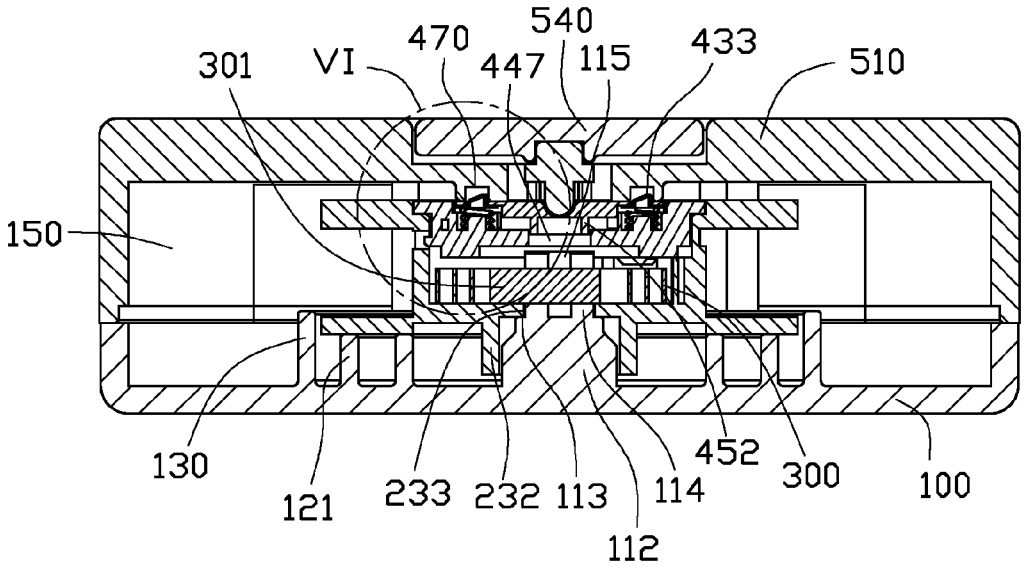
FIG. 5 is a cross-sectional view taken along line V-V of FIG. 1, showing an assembly of the container.

The pressing cover 450 includes a base plate 451 and a positioning projection 452 (see FIG. 5). The pressing cover 450 defines a number of locking through holes 453 in the base plate 451, a pressing hole 455 in a center of a top surface of the base plate 451, and a pair of positioning cutouts 454 at two opposite sides of a periphery of the base plate 451. The positioning projection 452 extends down from a center portion of a bottom surface of the base plate 451. In the illustrated embodiment, the positioning projection 452 is an annular projection.

Each of the locking blocks 430 includes a bottom plate 432 and a locking projection 433. The locking projection 433 extends up from the bottom plate 432. The locking projection 433 has an engaging surface 434 formed at a top thereof. The engaging surface 434 is oblique to the bottom plate 432. In this embodiment, the locking projection 433 is a circular post, and the second springs 420 are coil springs.

The top cover 500 includes a top board 510, a limiting sidewall 520, and a restricting block 550. The limiting sidewall 520 includes a pair of opposite outer parts 521 and a pair of opposite inner parts 524. The outer parts 521 correspondingly extend down from two opposite sides of a periphery of the top board 510. The inner parts 524 connect the corresponding ends of the two opposite outer parts 521. The inner parts 524 are bent inwards toward a center of the top board 510, to define a pair of second receiving spaces 522 at two opposite sides of the periphery of the top board 510. A pair of positioning slits 525 is defined in middle portions of the inner parts 524, respectively.

The top board 510 defines a round button recess 530 in a center of a top surface thereof. The top board 510 defines a transmission through hole 533 in a center thereof, the transmission through hole 533 being below and in communication with the button recess 530. The top board 510 includes a movable transmission arm 534. The transmission arm 534 extends radially inward from a periphery of the transmission through hole 533 to a center of the transmission through hole 533. The transmission arm 534 is integrally formed with the top board 510 as a single monolithic body of material. The transmission arm 534 and the top board 510 are made of flexible material. Thus, the transmission arm 534 can be resiliently bent in directions substantially perpendicular to the top board 510.

The transmission arm 534 includes a pair of contacting bumps 532, which are formed on opposite top and bottom sides of the transmission arm 534. That is, the contacting bumps 532 extend from the transmission arm 534 along directions perpendicular to the top board 510. The button 540 defines an engaging hole 541 in a bottom thereof, corresponding to the top one of the contacting bumps 532.

Figure 6:
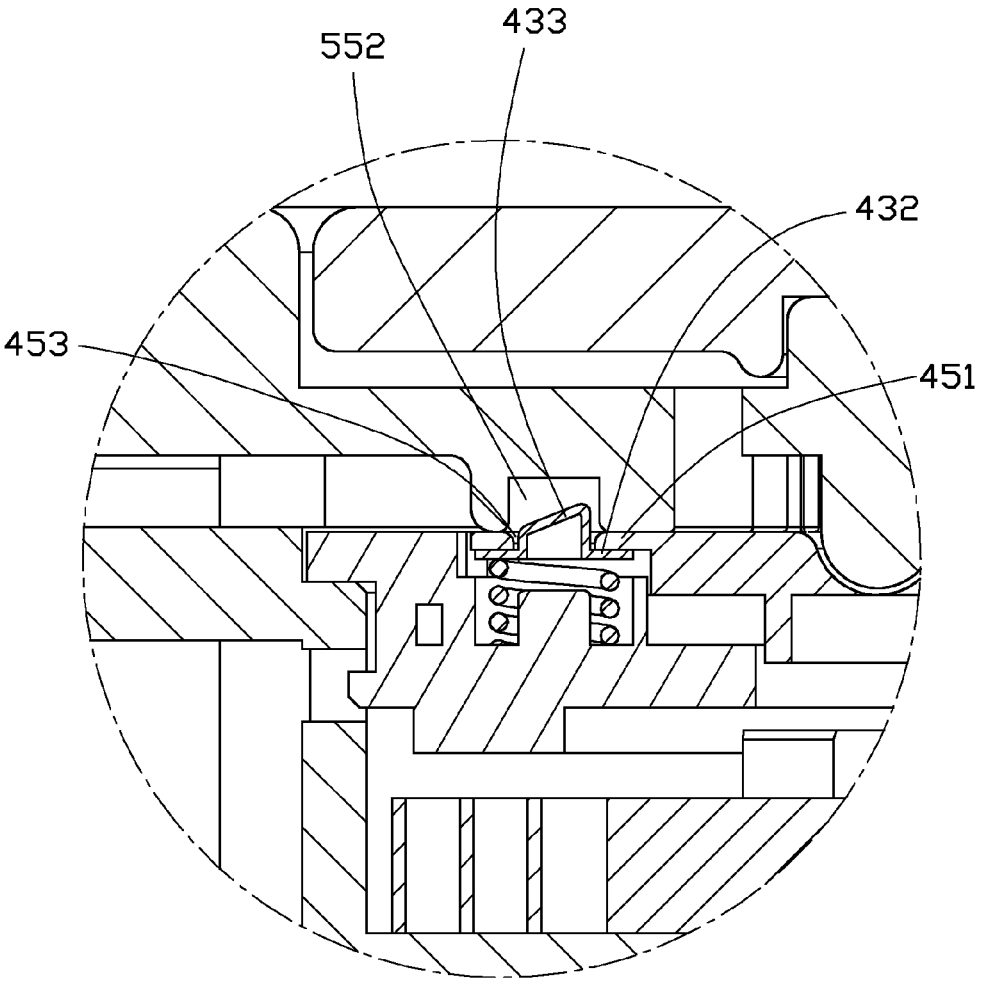
FIG. 6 is an enlarged view of a circled portion VI of FIG. 5.
Figure 7:
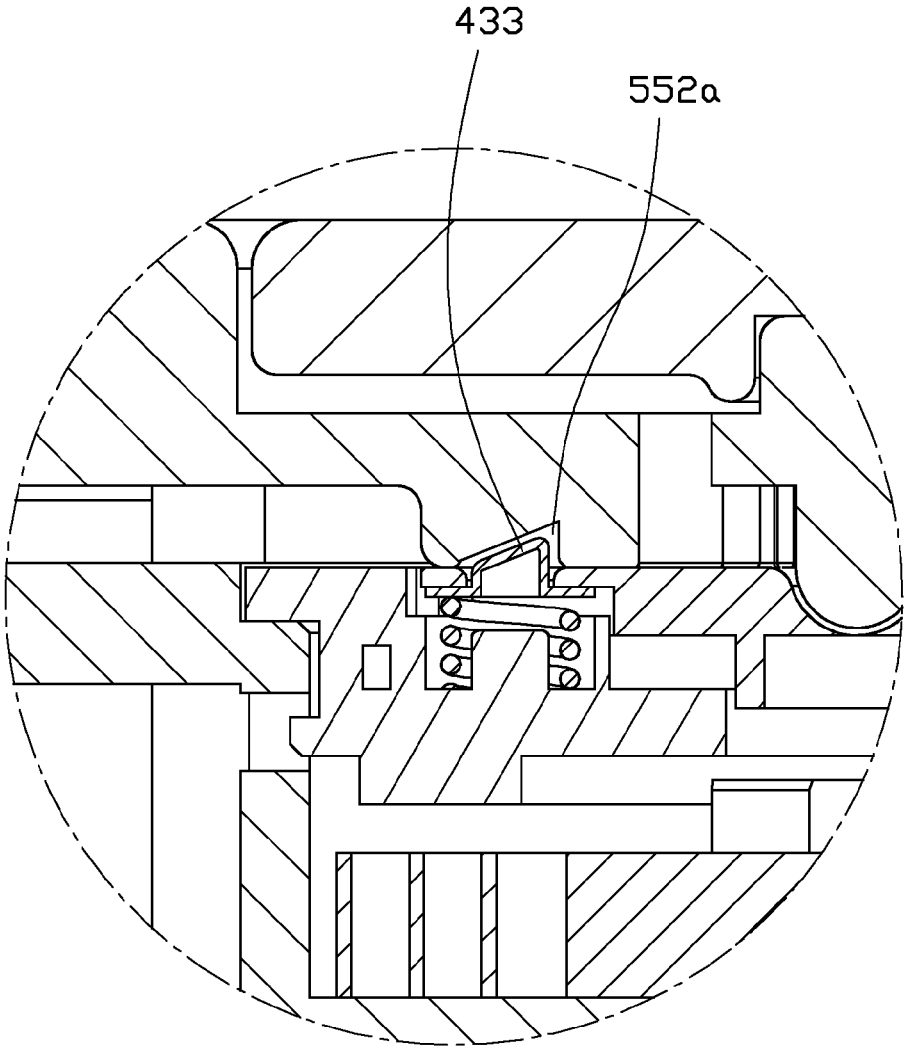
FIG. 7 is similar to FIG. 6, but showing components according to another exemplary embodiment.

The restricting block 550 is formed at a bottom surface of the top board 510. The restricting block 550 defines a number of restricting holes 552 therein. The restricting holes 552 correspond to the locking through holes 453, and are evenly distributed around the transmission through hole 533. In this embodiment, the restricting block 550 is substantially a ring shaped block encircling the transmission through hole 533. Referring also to FIG. 6, in the present embodiment, each of the restricting holes 552 is cylindrical. Referring also to FIG. 7, in other embodiments, each of restricting holes 552*a* defines a substantially triangular vertical cross-section.

A longer one of the receiving blocks 700 defines a first receiving groove 701. The other shorter one of the receiving blocks 700 defines a second receiving groove 702. The shielding boards 800 are configured for shielding the receiving blocks 700 when the receiving blocks 700 are assembled in the container 10.

FIGS. 1, 2 and 5 show that in assembly, the winder 200 is sleeved on the holding post 111, with the upper part 114 passing through the bottom through hole 233 and the bottom sidewall 232 closely encircling the lower part 112. An inner periphery of the lower board 230 around the bottom through hole 232 is supported on the step 113. An outer periphery of the lower board 230 is supported on the support sidewalls 121, and is restricted by the positioning sidewall 130. The inner end 301 of the first spring 300 is fastened in the fastening slit 115 of the upper part 114. The outer end 302 of the first spring 300 is fastened to the positioning block 213. Thus, the first spring 300 is received and positioned in the first receiving space 216. When the winder 200 rotates about the holding post 111 in either a clockwise or an anticlockwise direction, the first spring 300 is twisted.

The connecting base 440 is fixed in the first receiving space 216, with the connecting projections 446 correspondingly inserting into the positioning grooves 212 of the inner surface of the connecting sidewall 210. The second springs 420 correspondingly sleeve on the fixing protrusions 444. The locking blocks 430 are correspondingly supported on the second springs 420. The connecting base 440 thus covers the first spring 300. An included angle θ defined between facing directions of the engaging surfaces 434 of each two adjacent locking projections 433 is the same (see FIG. 4).

The pressing cover 450 is positioned to engage with and cover the connecting base 440, with the guiding projections 448 correspondingly inserting into the positioning cutouts 454, and the positioning projection 452 aligning with the connecting through hole 447. FIG. 6 shows that the base plate 451 abuts against the bottom plate 432 of each of the locking blocks 430. The locking projections 433 correspondingly pass through the locking through holes 453 to extend out from the pressing cover 450.

The top cover 500 is positioned to cover the main base 100. The tops of the locking projections 433 are correspondingly inserted into the restricting holes 552. The button 540 is received in the button recess 530, with the top contacting bump 532 fastened in the engaging hole 541. The other bottom contacting bump 532 is inserted into the pressing hole 455, and abuts or lightly contacts an inner peripheral surface of the base plate 451 that surrounds the pressing hole 455.

The cable 20 of the electronic device 22 wraps on an outer surface of the connecting sidewall 210. Some parts of the cable 20 are fastened to the positioning protrusions 215. In this embodiment, one end of the cable 20 is connected to the pair of earphones of the electronic device 22, and an opposite end of the cable 20 is connected to a connector of the electronic device 22. Thus the opposite ends of the cable 20 correspondingly pass through the positioning slits 525. The receiving blocks 700 are correspondingly received in the second receiving spaces 522. The earphones and the connector are received in the first receiving groove 701 and the second receiving groove 702, respectively. The shielding boards 800 correspondingly shield the receiving spaces 216, to improve the appearance of the container 10.

In use of the container 10, the earphones and the connector can be selectively pulled out away from the winder 200 via the second receiving spaces 216 at the two opposite sides of the top cover 500. In a passive state of the container 10, because the locking projections 433 are engaged in the restricting holes 552, the winder 200 is restricted and cannot rotate about the holding post 111. When either end of the cable 20 is pulled by a user, the winder 200 is forced to move in a plane perpendicular to the holding post 111. The winder 200 drives the engaging surfaces 434 of the locking projections 433 to engage with edges of the restricting holes 552. The locking projections 433 ride along the edges of the restricting holes 552 and are thereby forced to retract into the connecting base 440. Thus, the winder 200 is released from the top cover 500 and can rotate about the holding post 111. The cable 20 wrapped on the winder 200 is gradually pulled out from the winder 200 and drives the winder 200 to rotate about the holding post 111 in a first direction. The first spring 300 is twisted when the winder 200 rotates in the first direction, and accumulates elastic potential energy.

When the cable 20 is pulled out to a desired length and the user's force on the cable 20 is relaxed or released, the locking projections 433 may or may not be aligned with the restricting holes 552. If the locking projections 433 are not aligned with the restricting holes 552, the connecting base 440 automatically rewinds a small angle due to restoring force applied by the first spring 300, and as a result the locking projections 433 align with the restricting holes 552. If and when the locking projections 433 are aligned with the restricting holes 552, the locking projections 433 insert into the restricting holes 552 again due to restoring forces applied by the second springs 420. Thereby, back rotation of the winder 200 is prevented, and the cable 20 stays in position extended out from the container 10 a desired length.

It is understood that either end of the cable 20 can be pulled out from the winder 200 such that the winder 200 rotates in either the clockwise or the anticlockwise direction. However, ordinarily, both ends of the cable 20 are not be pulled out from the winder 200 at the same time.

When the cable 20 needs to be wrapped completely back on the winder 200, the button 540 is pressed, and the transmission arm 534 drives the pressing cover 450 to move downwards. The pressing cover 450 pushes the bottom plates 432 down, and thereby causes the locking projections 433 to escape from the restricting holes 552. Thus, the winder 200 is released from the top cover 500, and is driven to rotate in a second direction by the restoring force of the twisted first spring 300 of the winder 200. The second direction is contrary to the first direction. The cable 20 is thus automatically wrapped back on the winder 200 when the winder 200 is driven to rotate in the second direction.

While various exemplary and preferred embodiments have been described, it is to be understood that the disclosure is not limited thereto. To the contrary, various modifications and similar arrangements (as would be apparent to those skilled in the art) are intended to also be covered. Therefore, the scope of the appended claims should be accorded the broadest interpretation so as to encompass all such modifications and similar arrangements.

What is claimed is:

1. A container for accommodating a cable of an electronic device, the container comprising:

a main base;

a top cover placed on the main base, the top cover comprising a movable transmission arm, and the top cover and the main base cooperatively defining an accommodating space therebetween;

a winder received in the accommodating space and rotatable connected to the main base, the winder adapted for having the cable wound therearound, and comprising a spring for providing rotary force when the spring is twisted; and a locking mechanism received in the winder and configured for detachably fastening the winder to the top cover;

wherein when the cable is wrapped on the winder and an end of the cable is pulled away from the winder, the locking mechanism of the winder detaches from the top cover to allow unwinding of the cable, and the spring is twisted;

when the cable reaches a desired position unwound from the winder, the locking mechanism of the winder becomes aligned with the top cover such that the locking mechanism automatically re-fastens the winder to the top cover; and when the transmission arm is pushed, the transmission arm drives the locking mechanism away from the top cover such that the winder is detached from the top cover, whereupon the spring applies the rotary force to the winder such that the winder rewinds the cable;

wherein the locking mechanism comprises a connecting base, a pressing cover covering the connecting base, and a number of locking blocks retractably set on the connecting base, and a top of each locking block extends out of the pressing cover via a plurality of locking through holes defined in the pressing cover;

wherein the top cover comprises a restricting block, the restricting block defines a number of restricting holes corresponding to the locking through holes, and the tops of the locking blocks are inserted into the restricting holes when the locking mechanism fastens the winder to the top cover; and wherein the top cover further comprises a top board, and the restricting block is formed on a bottom surface of the top board;

wherein the top cover further comprises a limiting sidewall extending down from a periphery of the top board, the limiting sidewall comprises a pair of opposite outer parts and a pair of opposite inner parts, the outer parts correspondingly extend down from two opposite sides of the periphery of the top board, the inner parts connect the corresponding ends of the two opposite outer parts, and the inner parts are bent inwards toward a center of the top board and thereby define a pair of second receiving spaces at two opposite sides of the periphery of the top board.

2. The container of claim 1, further comprising a pair of receiving blocks correspondingly accommodated in the second receiving spaces and a pair of shielding boards, one of the receiving blocks defines a first receiving groove for receiving a part of the electronic device, the other one of the receiving blocks defines a second receiving groove for receiving a connector of the electronic device, and the shielding boards shield the receiving blocks accommodated in the second receiving spaces.

3. A container for accommodating a cable of an electronic device, the container comprising:

a main base;

a top cover placed on the main base, the top cover comprising a movable transmission arm, and the top cover and the main base cooperatively defining an accommodating space therebetween;

a winder received in the accommodating space and rotatably connected to the main base, the winder adapted for having the cable wound therearound, and comprising a spring for providing rotary force when the spring is twisted; and a locking mechanism received in the winder and configured for detachably fastening the winder to the top cover;

wherein when the cable is wrapped on the winder and an end of the cable is pulled away from the winder, the locking mechanism of the winder detaches from the top cover to allow unwinding of the cable, and the spring is twisted;

when the cable reaches a desired position unwound from the winder, the locking mechanism of the winder becomes aligned with the top cover such that the locking mechanism automatically re-fastens the winder to the top cover; and when the transmission arm is pushed, the transmission arm drives the locking mechanism away from the top cover such that the winder is detached from the top cover, whereupon the spring applies the rotary force to the winder such that the winder rewinds the cable;

wherein the locking mechanism comprises a connecting base, a pressing cover covering the connecting base, and a number of locking blocks retractably set on the connecting base, and a top of each locking block extends out of the pressing cover via a plurality of locking through holes defined in the pressing cover; and wherein the connecting base comprises a base board and a holding sidewall extending up from a periphery of the base board, the holding sidewall comprises a pair of guiding projections radially extending from two opposite sides of an inner surface thereof, the pressing cover defines at least a pair of positioning cutouts at two opposite sides of the base plate, and the pressing cover engages with and covers the connecting base by the guiding projections being correspondingly inserted into the positioning cutouts.

4. The container of claim 3, wherein the holding sidewall comprises a plurality of connecting projections radially extending from an outer surface thereof, the winder comprises an upper board, a lower board, and a connecting sidewall connecting the upper board and the lower board, the connecting sidewall defines a plurality of positioning grooves in an inner surface thereof, and the connecting base connects with the winder by the connecting projections being correspondingly inserted into the positioning grooves.

5. The container of claim 4, wherein the connecting sidewall defines a plurality of positioning through holes therein, the positioning through holes are distributed along a peripheral direction of the connecting sidewall at predetermined intervals, and each of the positioning through holes defines a positioning protrusion for fixing the cable.

6. The container of claim 4, wherein the main base comprises a holding post, and the winder is rotatably connected to the holding post.

7. The container of claim 6, wherein the holding post defines a fastening slit along a diameter thereof at a top thereof, the winder further comprises a positioning block extending from the inner surface of the connecting wall, one end of the spring is fastened in the fastening slit, and another end of the spring is fastened to the positioning block.

8. The container of claim 4, wherein the main base comprises a plurality of support sidewalls encircling the holding post and a positioning sidewall encircling the support sidewalls, a height of the positioning sidewall is greater than a height of each of the support sidewalls, and the lower board is supported on the support sidewalls and restricted by the positioning sidewall when the winder is rotatably connected to the holding post.

* * * * *

UNITED STATES PATENT AND TRADEMARK OFFICE

CERTIFICATE OF CORRECTION

PATENT NO. : 9,079,747 B2
APPLICATION NO. : 13/710487
DATED : July 14, 2015
INVENTOR(S) : Qun Huang and Zhou Chen It is certified that error appears in the above-identified patent and that said Letters Patent is hereby corrected as shown below:

Please replace Item (73) regarding "Assignees" on the title page of the Patent with the following:

(73) Assignees: Fu Tai Hua Industry (Shenzhen) Co., Ltd., Shenzhen (CN);
Hon Hai Precision Industry Co., Ltd., New Taipei (TW).

Signed and Sealed this
First Day of December, 2015

Michelle K. Lee

Michelle K. Lee
*Director of the United States Patent and Trademark Office*